US008272224B2

(12) United States Patent
Cihlar et al.

(10) Patent No.: US 8,272,224 B2
(45) Date of Patent: Sep. 25, 2012

(54) APPARATUS AND METHODS FOR FUEL NOZZLE FREQUENCY ADJUSTMENT

(75) Inventors: David Cihlar, Greenville, SC (US); Christopher Paul Keener, Woodruff, SC (US)

(73) Assignee: General Electric Company, Schenectady, NY (US)

( * ) Notice: Subject to any disclaimer, the term of this patent is extended or adjusted under 35 U.S.C. 154(b) by 578 days.

(21) Appl. No.: 12/610,576

(22) Filed: Nov. 2, 2009

(65) Prior Publication Data

US 2011/0100019 A1 May 5, 2011

(51) Int. Cl.
*F02C 7/20* (2006.01)

(52) U.S. Cl. ..... 60/796; 60/737

(58) Field of Classification Search ..... 60/39.37, 60/725, 737, 738, 740, 742, 747, 748, 772, 60/796–800; 431/8, 159, 174, 278, 285
See application file for complete search history.

(56) References Cited

U.S. PATENT DOCUMENTS 5,357,745 A 10/1994 Probert
6,354,071 B2 3/2002 Tegel et al.
6,427,446 B1 8/2002 Kraft et al.
6,438,959 B1 8/2002 Dean et al.
6,923,002 B2 8/2005 Crawley et al.
7,210,297 B2 5/2007 Shah et al
7,278,266 B2 10/2007 Taware et al.
7,284,378 B2 10/2007 Amond, III et al.
7,581,402 B2 * 9/2009 Parker ..... 60/798
8,127,550 B2 * 3/2012 Harris et al. ..... 60/748
2006/0254279 A1 11/2006 Taware et al.
2007/0062196 A1 3/2007 Gleeson et al.

* cited by examiner

*Primary Examiner* — Phutthiwat Wongwian
(74) *Attorney, Agent, or Firm* — Nixon & Vanderhye, P.C.

(57) ABSTRACT

A combustion liner cap assembly includes a cylindrical outer sleeve. The cylindrical outer sleeve includes a center fuel nozzle opening and a plurality of outer fuel nozzle openings spaced around the center fuel nozzle. A mounting flange assembly concentrically surrounds the cylindrical outer sleeve. A plurality of struts on an outer surface of the cylindrical outer sleeve support the mounting flange assembly. A plurality of flanges are on the outer surface of the cylindrical outer sleeve; and a plurality of support rods having first ends are adjustably supported by respective flanges. A combustor for a gas turbine includes a combustion liner cap assembly, a plurality of outer fuel nozzles supported in the plurality of outer fuel nozzle openings, and a center fuel nozzle supported in the center fuel nozzle opening. Second ends of the plurality of support rods adjustably contact the center fuel nozzle.

18 Claims, 7 Drawing Sheets

APPARATUS AND METHODS FOR FUEL NOZZLE FREQUENCY ADJUSTMENT

The present invention relates to apparatus and methods for fuel nozzle frequency adjustment.

BACKGROUND OF THE INVENTION

Natural frequency of the fuel nozzles is a frequent issue in combustion systems. Adjustment of the frequency above all combustion and rotor tones is desired. However, due to the limited available space in this region, previous designs have been unable to sufficiently dampen the hardware.

BRIEF DESCRIPTION OF THE INVENTION

According to a sample embodiment, a combustion liner cap assembly comprises a cylindrical outer sleeve, the cylindrical outer sleeve comprising a center fuel nozzle opening and a plurality of outer fuel nozzle openings spaced around the center fuel nozzle; a mounting flange assembly concentrically surrounding the cylindrical outer sleeve; a plurality of struts on an outer surface of the cylindrical outer sleeve that support the mounting flange assembly; a plurality of flanges on the outer surface of the cylindrical outer sleeve; and a plurality of support rods having first ends adjustably supported by respective flanges.

According to another sample embodiment, a combustor for a gas turbine comprises a combustion liner cap assembly as described in the preceding paragraph; a plurality of outer fuel nozzles supported in the plurality of outer fuel nozzle openings; and a center fuel nozzle supported in the center fuel nozzle opening, wherein second ends of the plurality of support rods adjustably contact the center fuel nozzle.

According to a further sample embodiment, a method of adjusting frequencies of a plurality of fuel nozzles in a combustor of a gas turbine according to the preceding paragraph comprises adjusting contact between second ends of the support rods and the center fuel nozzle.

DETAILED DESCRIPTION OF THE INVENTION

Figure 1:
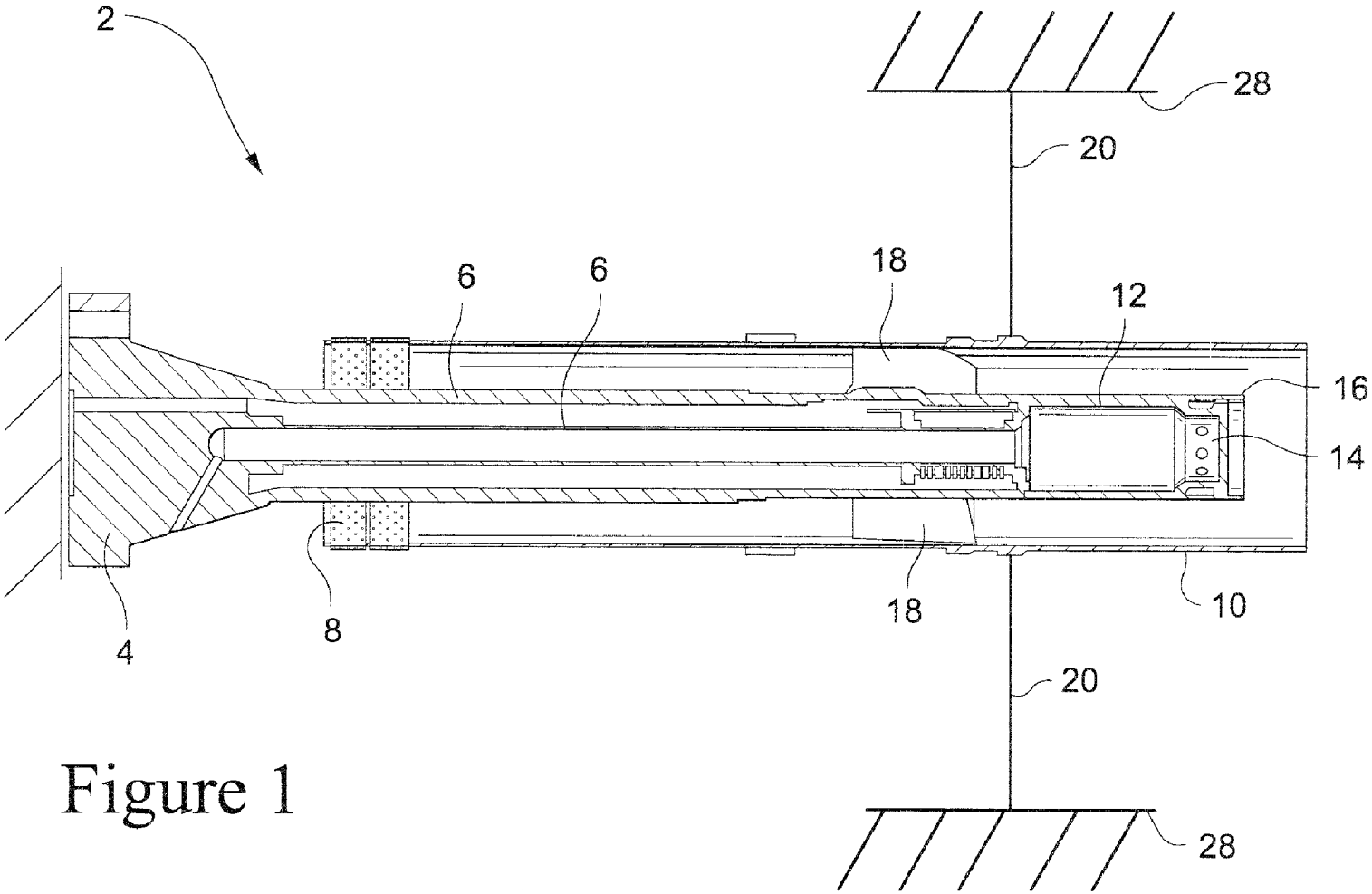
FIG. 1 schematically depicts a fuel nozzle support according to an embodiment of the invention.

Referring to FIG. 1, a combustor comprises a center fuel nozzle 2. The center fuel nozzle 2 comprises concentric tube assemblies 6 that are supported at one end by a flange assembly 4. The center fuel nozzle 2 further comprises an inlet flow conditioner 8, for example a sheet metal screen. A shroud 10 is provided around the concentric tube assemblies 6.

The concentric tube assemblies 6 comprise a hub 12 having diffusion metering holes 14 at a fuel nozzle aft tip 16. A swirling vane or vanes 18 (i.e. a swozzle) is provided in the shroud 10 around the concentric tube assembly 6.

The concentric tube assemblies 6 of the center fuel nozzle 2 are supported by a plurality of support rods 20 that are provided between a cylindrical outer sleeve 28 and the outer surface of the shroud 10. The support rods 20 contact the center fuel nozzle.

Figure 2:
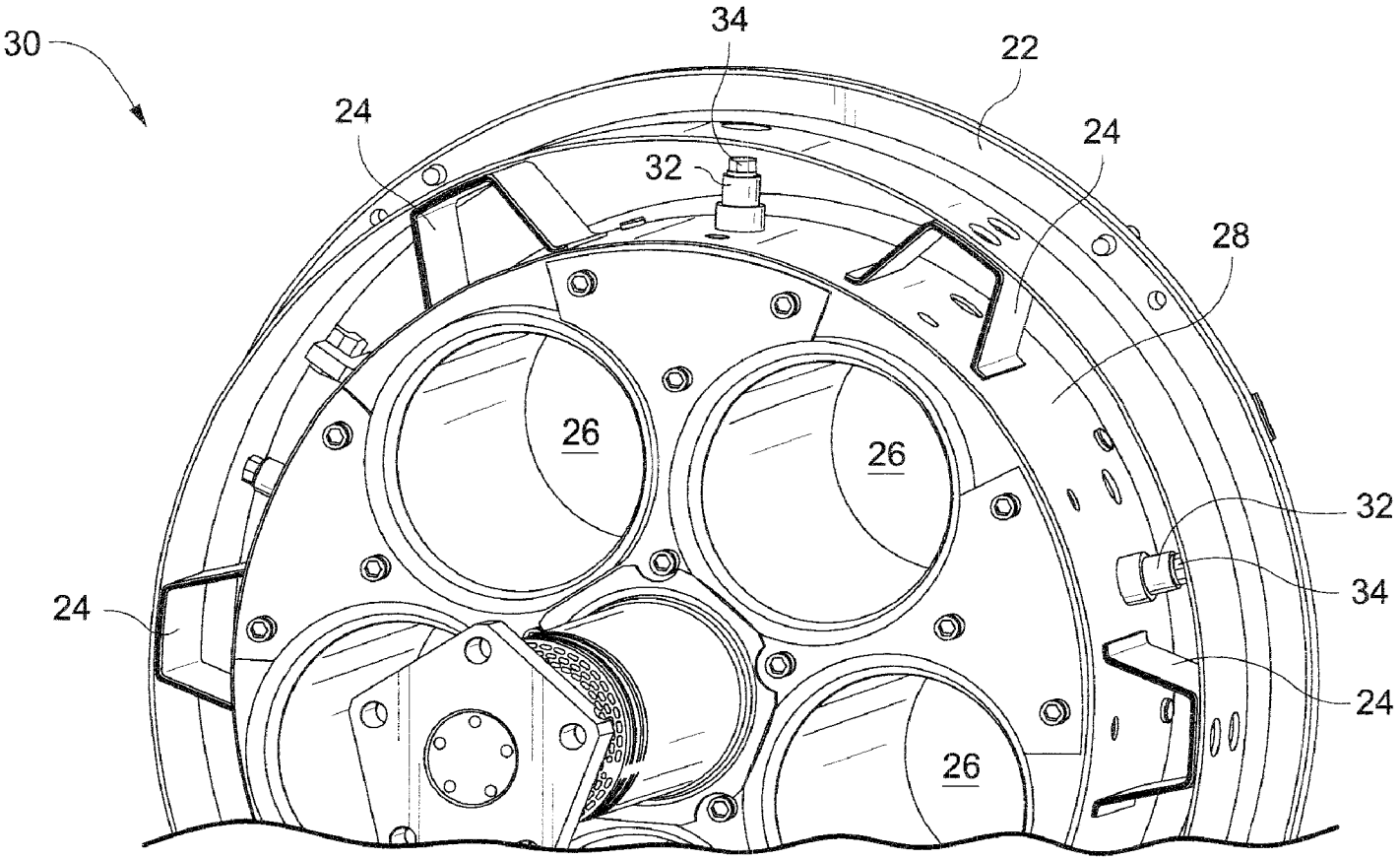
FIG. 2 schematically illustrates a combustion liner cap assembly according to an embodiment of the invention.
Figure 3:
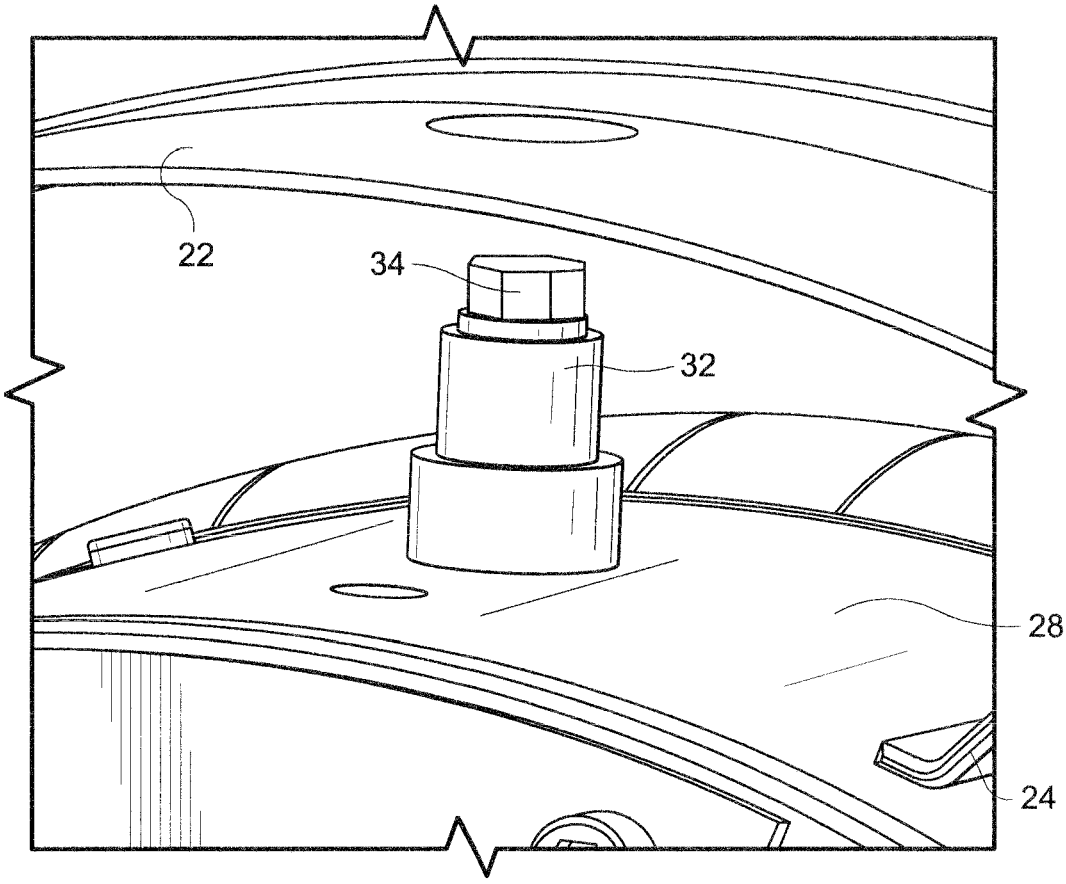
FIG. 3 schematically depicts a portion of the combustion liner cap assembly of FIG. 2 including a support rod.
Figure 4:
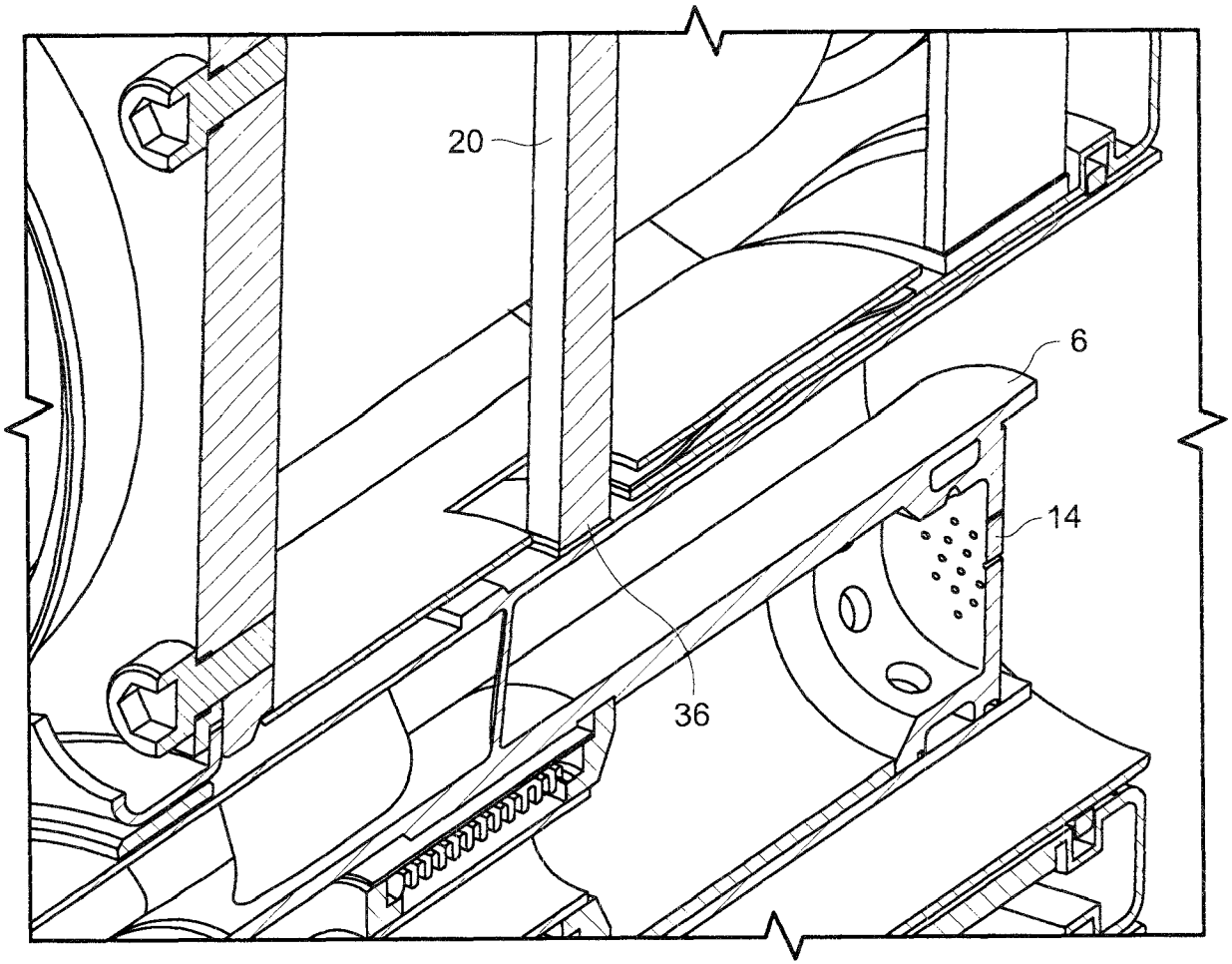
FIG. 4 schematically depicts a portion of the fuel nozzle support of FIG. 1 including a support rod.

Referring to FIGS. 2 and 3, a combustion liner cap assembly 30 of the combustor comprises a mounting flange assembly 22 that concentrically surrounds the cylindrical outer sleeve 28. A plurality of struts 24 support the mounting flange assembly 22 around the cylindrical outer sleeve. The cylindrical outer sleeve 28 comprises a plurality of outer fuel nozzle openings 26 which are concentrically spaced around the center fuel nozzle.

The cylindrical outer sleeve 28 comprises a plurality of threaded flanges 32 which receive support rod first ends 34 that are threadably engaged with the threaded flanges 32.

Figure 5:
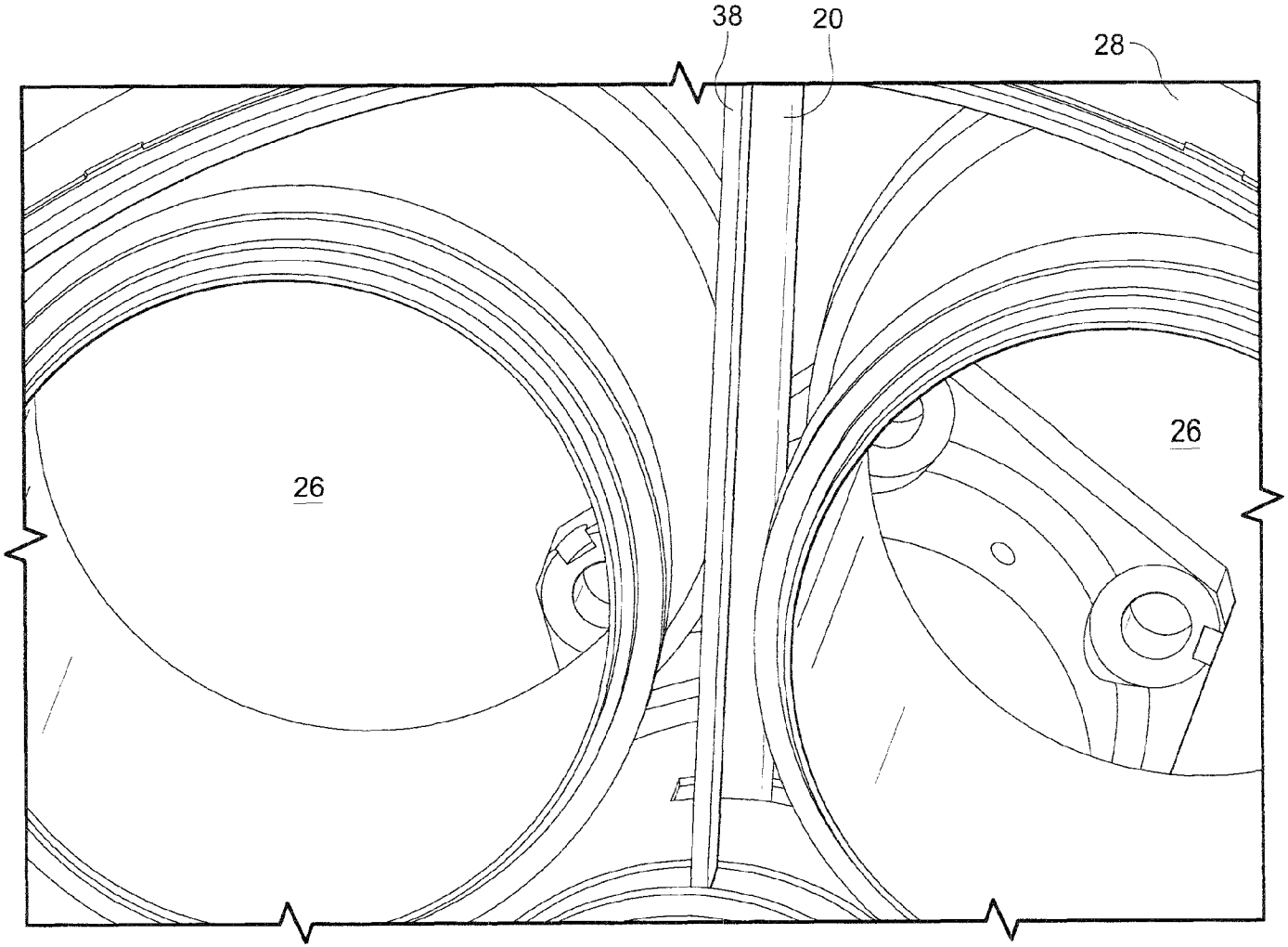
FIG. 5 schematically depicts a portion of the combustion liner cap assembly of FIG. 2 including a support rod.
Figure 6:
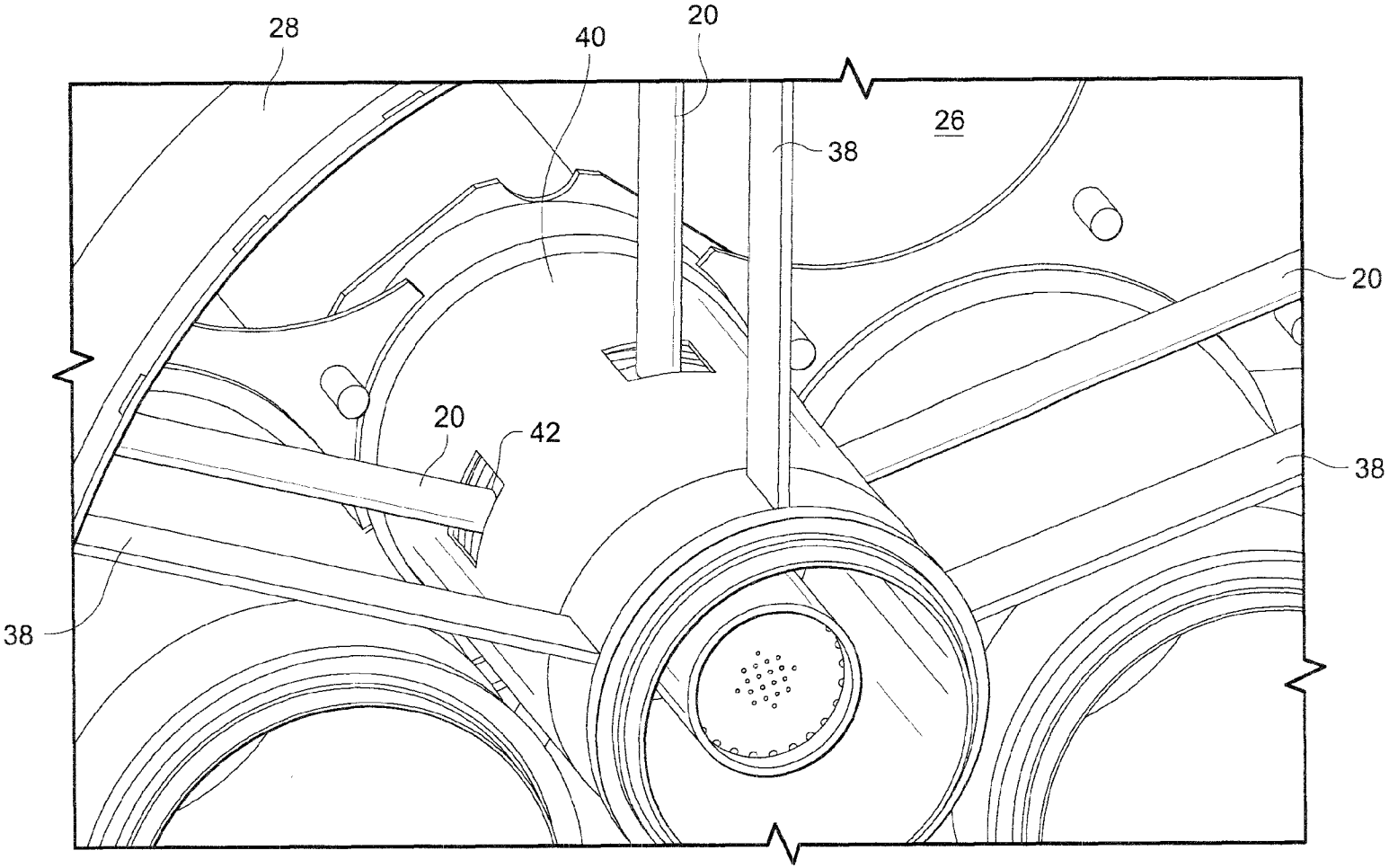
FIG. 6 schematically depicts a portion of the combustion liner cap assembly of FIG. 2 including a support rod and sleeve.
Figure 7:
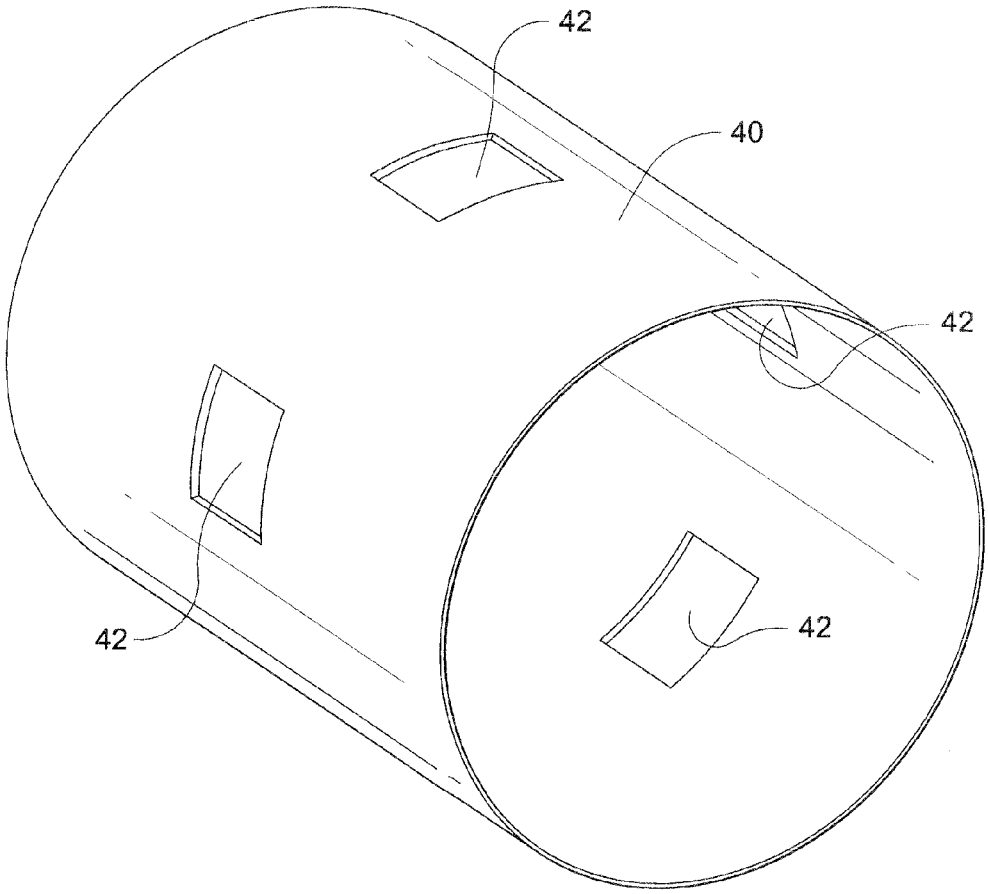
FIG. 7 schematically depicts a sleeve of the combustion liner cap assembly according to a sample embodiment.

Referring to FIGS. 4-7, the support rods 20 include second ends 36 that contact the center fuel nozzle 2. As shown in FIG. 5, the combustor further comprises support plates 38 that support a sleeve 40. The sleeve 40 comprises a plurality of support rod apertures 42 that receive the second ends of the support rods 20.

In order to provide added stiffness to the fuel nozzles, the support, or stiffening, rods 20 are added to the cap assembly 30 and are synched against the burner tube of the fuel nozzle. The addition of the support rods 20 provides sufficient damping to increase the natural frequency of the fuel nozzle beyond any combustion or rotor tones, and reduces the amplitude response through the increased dampening. The rods 20 are threaded through the added flange on the cap to allow for synching of the fuel nozzles. The tips of the rods 20 that contact the fuel nozzle 2 can be fitted with a multiple designs depending on the operating conditions; bare metal, wire mesh, wear coating, etc.

The stiffening rods 20 provide sufficient stiffness to increase the natural frequency of the fuel nozzle beyond any combustion and rotor tones, and reduce the amplitude response through the increased dampening. This increase in stiffness allows for a more robust and durable fuel design capable of exceeding current hardware performance.

The stiffening rods 20 can be retrofitted against any combustion system with no design changes required on the fuel nozzle and only slight modifications on the cap, allowing for salvage of fielded hardware. Use of existing hardware allows customers to continue operation until part life is reached.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A combustion liner cap assembly, comprising:

a cylindrical outer sleeve, the cylindrical outer sleeve comprising a center fuel nozzle opening and a plurality of outer fuel nozzle openings spaced around a center fuel nozzle located within the center fuel nozzle opening;

a mounting flange assembly concentrically surrounding the cylindrical outer sleeve;

a plurality of struts on an outer surface of the cylindrical outer sleeve that support the mounting flange assembly;

a plurality of flanges on the outer surface of the cylindrical outer sleeve; and a plurality of support rods having first ends adjustably supported by respective flanges and second ends contacting the center fuel nozzle.

2. A combustion liner cap assembly according to claim 1, wherein the flanges are threaded and the first ends of the support rods are threaded into the flanges.

3. A combustion liner cap assembly according to claim 1, further comprising a sleeve provided in the center fuel nozzle opening, the sleeve comprising a plurality of apertures in an outer surface, each configured to receive a respective second end of one of the plurality of support rods.

4. A combustion liner cap assembly according to claim 3, further comprising a plurality of support plates configured to support the sleeve on the cylindrical outer sleeve.

5. A combustion liner cap assembly according to claim 3, wherein the second ends of the support rods comprise at least one of bare metal, a wire mesh or wear coating.

6. A combustor for a gas turbine, comprising:

a combustion liner cap assembly, the combustion liner cap assembly comprising a cylindrical outer sleeve, the cylindrical outer sleeve comprising a center fuel nozzle opening and a plurality of outer fuel nozzle openings spaced around the center fuel nozzle, a mounting flange assembly concentrically surrounding the cylindrical outer sleeve, a plurality of struts on an outer surface of the cylindrical outer sleeve that support the mounting flange assembly, a plurality of flanges on the outer surface of the cylindrical outer sleeve, and a plurality of support rods having first ends adjustably supported by respective flanges;

a plurality of outer fuel nozzles supported in the plurality of outer fuel nozzle openings; and a center fuel nozzle supported in the center fuel nozzle opening, wherein second ends of the plurality of support rods adjustably contact the center fuel nozzle.

7. A combustor according to claim 6, wherein the flanges are threaded and the first ends of the support rods are threaded into the flanges.

8. A combustor according to claim 6, further comprising a sleeve provided in the center fuel nozzle opening, the sleeve comprising a plurality of apertures in an outer surface, each configured to receive a respective second end of one of the plurality of support rods.

9. A combustor according to claim 8, further comprising a plurality of support plates configured to support the sleeve on the cylindrical outer sleeve.

10. A combustor according to claim 8, wherein the second ends of the support rods comprise at least one of bare metal, a wire mesh or a wear coating.

11. A combustor according to claim 6, wherein the center fuel nozzle comprises at least one swirling vane, and the second ends of the plurality of support rods adjustably contact the center fuel nozzle adjacent the at least one swirling vane.

12. A method of adjusting frequencies of a plurality of fuel nozzles in a combustor of a gas turbine comprising a a combustion liner cap assembly, the combustion liner cap assembly comprising a cylindrical outer sleeve, the cylindrical outer sleeve comprising a center fuel nozzle opening and a plurality of outer fuel nozzle openings spaced around the center fuel nozzle, a mounting flange assembly concentrically surrounding the cylindrical outer sleeve, a plurality of struts on an outer surface of the cylindrical outer sleeve that support the mounting flange assembly, a plurality of flanges on the outer surface of the cylindrical outer sleeve, and a plurality of support rods having first ends adjustably supported by respective flanges, the combustor further comprising a plurality of outer fuel nozzles supported in the plurality of outer fuel nozzle openings, and a center fuel nozzle supported in the center fuel nozzle opening, the method comprising:

adjusting contact between second ends of the support rods and the center fuel nozzle.

13. A method according to claim 12, wherein the flanges are threaded and the first ends of the support rods are threaded into the flanges.

14. A method according to claim 12, wherein the combustor further comprises a sleeve provided in the center fuel nozzle opening, the sleeve comprising a plurality of apertures in an outer surface configured to receive respective second ends of the support rods.

15. A method according to claim 12, wherein the combustor further comprises a plurality of support plates configured to support the sleeve on the cylindrical outer sleeve.

16. A method according to claim 12, wherein the second ends of the support rods comprise bare metal, a wire mesh or a wear coating.

17. A method according to claim 12, wherein the center fuel nozzle comprises at least one swirling vane, and the second ends of the plurality of support rods adjustably contact the center fuel nozzle adjacent the at least one swirling vane.

18. A method according to claim 12, wherein adjusting the contact between the second ends of the support rods and the center fuel nozzle comprises adjusting the contact so that the frequency of the fuel nozzles is above all combustion and rotor tones, and the amplitude response is sufficiently dampened.

* * * * *